US008066282B2

(12) United States Patent
Müller et al.

(10) Patent No.: US 8,066,282 B2
(45) Date of Patent: Nov. 29, 2011

(54) APPARATUS FOR FEEDING AND ALIGNING SHEETS FED TO A PROCESSING MACHINE, IN PARTICULAR A PRINTING MACHINE

(75) Inventors: Andreas Müller, Heidelberg (DE); Burkhard Wolf, Dosseheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 190 days.

(21) Appl. No.: 12/501,781

(22) Filed: Jul. 13, 2009

(65) Prior Publication Data

US 2010/0007082 A1 Jan. 14, 2010

(30) Foreign Application Priority Data

Jul. 11, 2008 (DE) ..... 10 2008 032 755

(51) Int. Cl.
*B65H 5/02* (2006.01)

(52) U.S. Cl. ..... 271/276; 271/194; 271/196; 271/197

(58) Field of Classification Search ..... 271/107, 271/276, 91, 92, 194
See application file for complete search history.

(56) References Cited

U.S. PATENT DOCUMENTS 3,661,245 A * 5/1972 Mol et al. ..... 198/688.1
3,984,095 A * 10/1976 Zimmer ..... 271/121
4,135,808 A * 1/1979 Morrison ..... 399/217
4,190,185 A * 2/1980 Thate ..... 226/172
4,432,540 A * 2/1984 Akers et al. ..... 271/8.1
4,470,591 A * 9/1984 Acquaviva ..... 271/245
4,651,984 A 3/1987 Emrich
4,696,465 A * 9/1987 Willi ..... 271/237
4,831,419 A * 5/1989 Iaia et al. ..... 355/76
4,935,780 A * 6/1990 Yamada et al. ..... 399/203
5,774,153 A * 6/1998 Kuehnle et al. ..... 347/129
5,794,176 A * 8/1998 Milillo ..... 702/150
5,931,457 A * 8/1999 Todoki ..... 271/184
6,213,282 B1 4/2001 Mokler et al.
6,216,848 B1 * 4/2001 Zens ..... 198/689.1

(Continued)

FOREIGN PATENT DOCUMENTS

DE 33 31 662 A1 3/1985

(Continued)

OTHER PUBLICATIONS

German Patent and Trademark Office Search Report, dated May 4, 2009.

*Primary Examiner* — Stefanos Karmis
*Assistant Examiner* — Howard Sanders
(74) *Attorney, Agent, or Firm* — Laurence A. Greenberg; Werner H. Stemer; Ralph E. Locher

(57) ABSTRACT

An apparatus for feeding and aligning sheets which are fed to a processing machine, e.g. a printing machine, includes at least two parallel transporting belts which, on a side directed toward the sheet, subject the sheet to different retaining forces, in such a way that the retaining force in outer peripheral regions is greater than in an inner region located therebetween. The transporting belts can be activated individually in dependence on the position of the sheet, and they can therefore align the sheet in its transporting direction and obliquely thereto.

10 Claims, 3 Drawing Sheets

U.S. PATENT DOCUMENTS

| | | | | |
|---|---|---|---|---|
| 6,971,647 | B2 | 12/2005 | Jewell et al. | |
| 2008/0111297 | A1* | 5/2008 | Fujita et al. | 271/227 |
| 2009/0174138 | A1* | 7/2009 | Abe | 271/276 |
| 2009/0212497 | A1* | 8/2009 | Kawaguchi et al. | 271/308 |
| 2010/0025918 | A1* | 2/2010 | Miyazawa | 271/12 |
| 2010/0244364 | A1* | 9/2010 | Komiyama et al. | 271/12 |

FOREIGN PATENT DOCUMENTS

| | | | |
|---|---|---|---|
| DE | 34 10 029 | C1 | 8/1985 |
| DE | 198 14 141 | C2 | 10/1999 |
| DE | 10 2004 017 186 | A1 | 2/2005 |
| DE | 10 2007 009 676 | A1 | 9/2008 |
| EP | 0 926 086 | A2 | 6/1999 |

* cited by examiner

APPARATUS FOR FEEDING AND ALIGNING SHEETS FED TO A PROCESSING MACHINE, IN PARTICULAR A PRINTING MACHINE

CROSS-REFERENCE TO RELATED APPLICATION

This application claims the priority, under 35 U.S.C. §119, of German Patent Application DE 10 2008 032 755.7, filed Jul. 11, 2008; the prior application is herewith incorporated by reference in its entirety.

BACKGROUND OF THE INVENTION

Field of the Invention

The invention relates to an apparatus for feeding sheets to a sheet-processing machine, with the sheets being aligned as they are being fed.

German Patent DE 198 14 141 C2, corresponding to U.S. Pat. No. 6,213,282, discloses an apparatus for feeding sheet-like articles, e.g. sheet-metal panels, to a processing machine. The sheet-like articles are transported through the use of two spaced-apart parallel suction belts which can be driven independently of one another at various speeds.

European Patent EP 0 926 086 B1 discloses two parallel suction belts having deflecting rollers mounted on a drivable axial element. In order to generate different speeds for the suction belts, the circumference of the deflecting rollers is changed through the use of controllable expansion elements. Driving the suction belts at different speeds may result in deformation of the article which is to be transported.

SUMMARY OF THE INVENTION

It is accordingly an object of the invention to provide an apparatus for feeding and aligning sheets fed to a processing machine, in particular a printing machine, which overcomes the hereinafore-mentioned disadvantages of the heretofore-known devices of this general type and which corrects oblique positioning of the sheets as they are being fed to a sheet-processing machine, with the intention being to avoid deformation in the sheets, in particular the formation of creases.

With the foregoing and other objects in view there is provided, in accordance with the invention, a particularly advantageous configuration which provides two transporting belts which are disposed one beside the other, with only a small spacing between them, in which the sheet-retaining force thereof is greater in an outer peripheral region than in an inner region located between the outer regions.

The sheet is thus fully supported in the center over a relatively large width and, in the case of correcting oblique positioning, can be displaced on the "smooth" inner region in relation to the transporting belt without deformation occurring.

The retaining force in the outer transporting region can be achieved by roughness of the transporting-belt surface or preferably by the action of suction air.

With the objects of the invention in view, there is also provided a second exemplary embodiment which provides for two transporting belts to have a third supporting belt disposed between them. This third belt is driven at an average speed and exhibits a lower retaining force than the two transporting belts.

In a particularly advantageous embodiment, the supporting belt may be provided with a smooth coating, e.g. polytetrafluoroethylene (PTFE) sold under the brand name TEFLON or an aluminum coating.

Other features which are considered as characteristic for the invention are set forth in the appended claims.

Although the invention is illustrated and described herein as embodied in an apparatus for feeding and aligning sheets which are fed to a processing machine, in particular a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
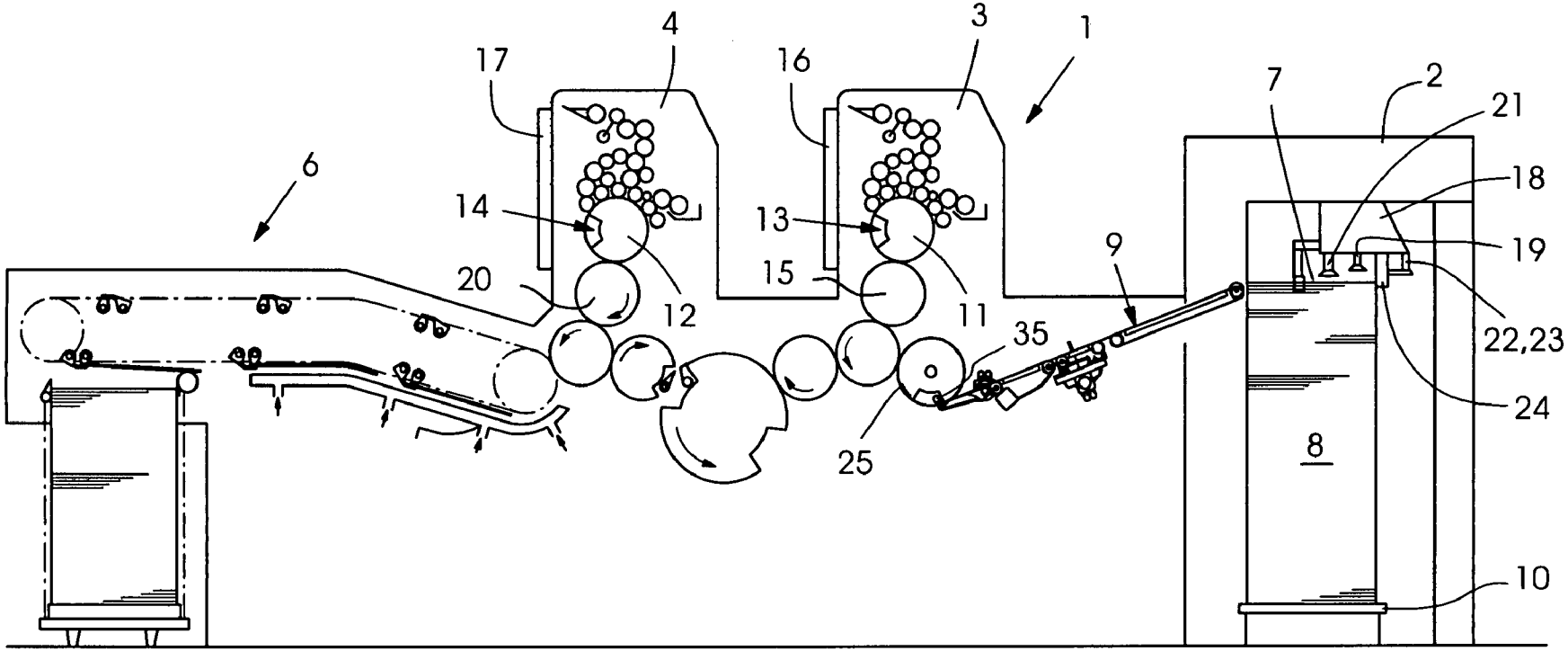
FIG. 1 is a diagrammatic, longitudinal-sectional view of a rotary printing machine.

Referring now to the figures of the drawings in detail and first, particularly, to FIG. 1 thereof, there is seen a machine for processing sheets 7, e.g. a printing machine 1, which has a feeder 2, at least one printing unit 3 or 4 and a delivery 6. The sheets 7 are removed from a sheet stack 8 and fed separately or in imbricated form to the printing units 3 and 4 over a feed table 9. These printing units each contain, in a known manner, a plate cylinder 11, 12 and blanket cylinders 15, 20, which respectively interact with the plate cylinders. The plate cylinders 11 and 12 each have a clamping device 13, 14 for fastening flexible printing plates. Furthermore, each plate cylinder 11, 12 is assigned a device 16, 17 for semi-automatic or fully automatic printing-plate changeover.

The sheet stack 8 rests on a stacking panel 10 which can be raised in a controlled manner. The sheets 7 are removed from the top side of the sheet stack 8 through the use of a so-called suction head 18 which has, inter alia, a number of lifting and pulling suckers 19, 21 for separating the sheets 7. Blowing devices 22 for loosening the top sheet layers and sensing elements 23 for stack adjustment are also provided. A number of lateral and rear stops 24 are provided in order to align the sheet stack 8, in particular the top sheet 7 of the sheet stack 8.

Figure 2:
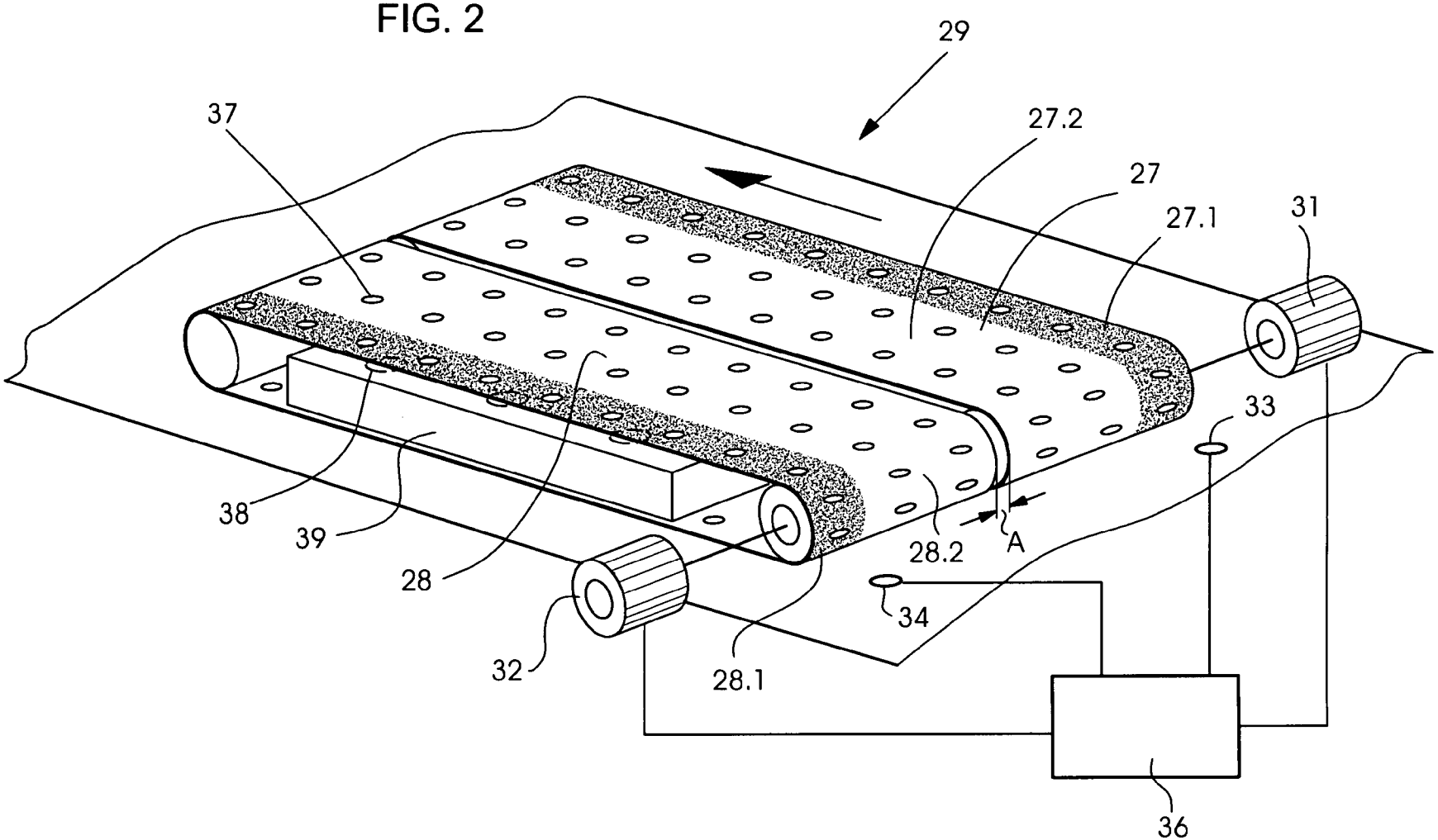
FIG. 2 is a fragmentary, perspective view of a transporting configuration for sheets.
Figure 3:
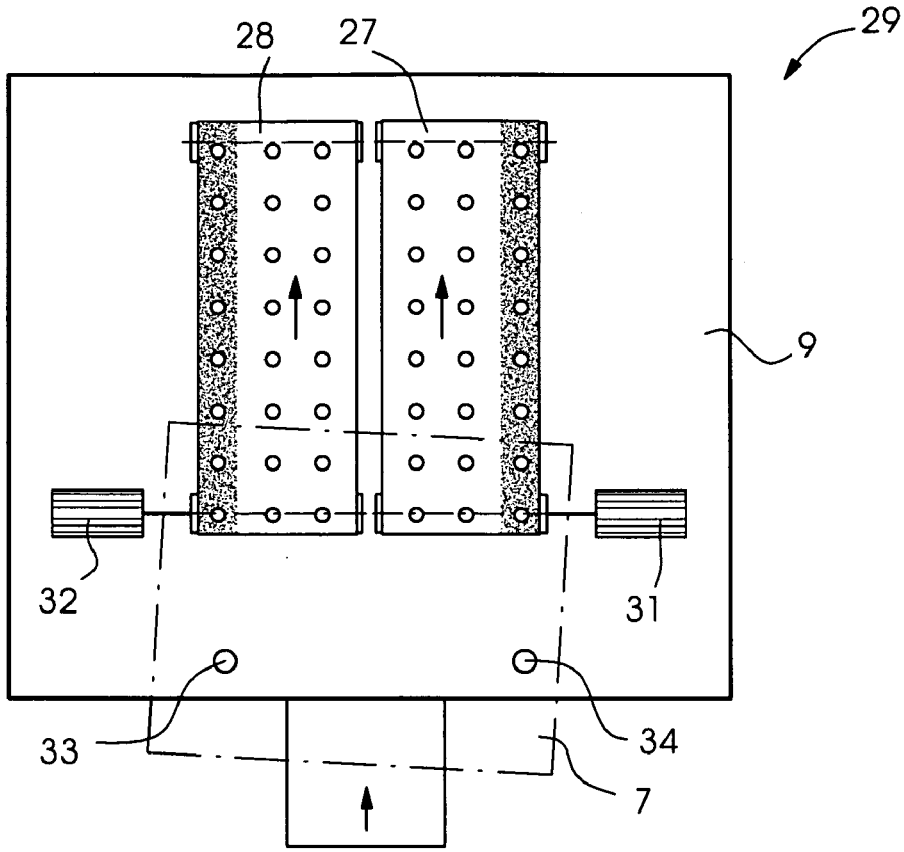
FIG. 3 is a top-plan view of a first exemplary embodiment of the transporting configuration.

As is seen in FIGS. 2 and 3, the feed table 9 has at least two parallel transporting belts 27, 28, which are constructed as so-called "suction belts," for the purpose of transporting the imbricated stream. The transporting belts 27, 28 can be driven in an individually adjustable manner, preferably continuously in time with the sheet-processing machine, by respective drive motors 31, 32 or by the feeder of the printing machine, through the use of adjustable differential gear mechanisms.

A plurality of sheet-transporting and/or sheet-accelerating stations may be provided on a transporting section from the feeder stack 8 to a feed cylinder 25 shown in FIG. 1. At least one sheet-transporting and/or sheet-accelerating unit 29 shown in FIG. 2 is constructed in such a way that it can be activated appropriately in order to align the sheets 7.

The dedicated drives 31, 32 of the transporting belts 27, 28 of the sheet-transporting and/or sheet-accelerating unit 29 determine drive data for the drives 31, 32 in dependence on an actual position value of the sheet 7 sensed through the use of sensors 33, 34 and a resulting desired/actual value comparison through the use of a control computer 36.

The sensors 33, 34 in this case sense the leading edge of the sheet 7.

The transporting belts 27, 28 are disposed one beside the other with only a very small spacing A (A=e.g. 1 millimeter) between them, and they therefore provide a relatively large, closed bearing surface for the sheet 7.

The spacing A between the transporting belts 27, 28 substantially prevents friction by moving the transporting belts 27, 28 relative to one another when the drives 31, 32 are activated differently.

Each transporting belt 27, 28 exhibits along its outer peripheral region 27.1, 28.1, directed away from the other transporting belt, a higher retaining force (e.g. frictional force) than along an inner region 27.2, 28.2.

A higher coefficient of friction or the higher retaining force may be achieved, for example, by corresponding roughness of the surface of the transporting belt 27, 28 or preferably by the transporting belt containing suction holes 37, which communicate with suction bores 38 in a suction table 39 located therebelow.

For the purpose of aligning the sheets, the sensors 33, 34, in a first instance, measure the position of the leading sheet edge. The control computer 36 uses the positional information determined by the sensors 33, 34 to generate manipulated variables for respective transporting speeds of the transporting belts 27, 28. This measure allows the sheets to be aligned both in their transporting direction and also obliquely.

The oblique positioning of the sheet seen in FIG. 3 is corrected by one of the two parallel transporting belts 27, 28 being driven briefly at a different speed. In this case, the sheet is retained at a high level of force (high static friction and possibly high negative pressure) only on two relatively small surfaces along the outer periphery of the two transporting belts 27, 28. It is indeed possible for the sheet to be subjected to negative pressure in the inner retaining regions 27.2, 28.2, but only to the extent where it is held down reliably, but can move on the inner region 27.2, 28.2 with a low coefficient of friction. The different speeds of the two parallel transporting belts 27, 28 results in an increase in the spacing between the two outer retaining regions 27.1, 28.1, which execute a rotary movement relative to one another. The sheet thus tends to be tensioned, which counteracts any formation of creases in this region.

Figure 4:
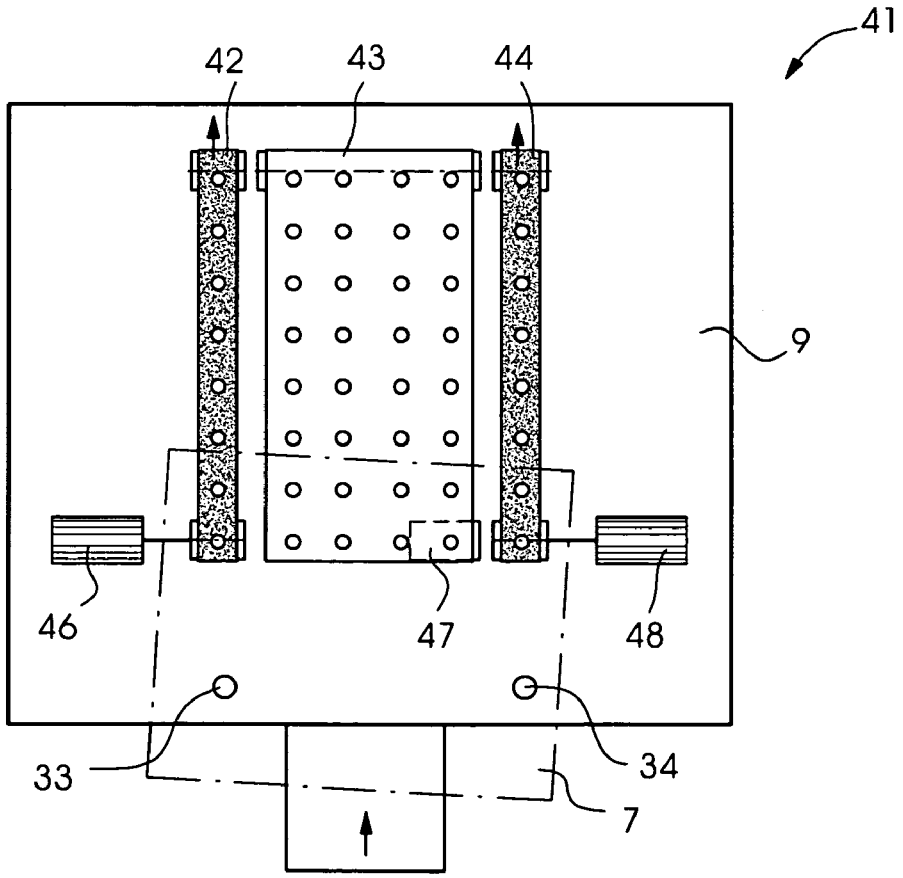
FIG. 4 is a top-plan view of a second exemplary embodiment of the transporting configuration.

A second exemplary embodiment according to FIG. 4 provides a transporting and/or accelerating unit 41 with three transporting belts 42, 43, 44 disposed parallel, one beside the other. The outer transporting belts 42, 44 exhibit an increased level of retaining force in relation to the central transporting belt 43. The transporting belts 42, 44 are constructed, for example, as suction belts. The central transporting belt 43 may be of very smooth construction or may have a coating, e.g. TEFLON or aluminum for the purpose of reducing its adhering force.

Each of the transporting belts 42, 43, 44 have a respective individually activatable drive 46, 47, 48. The outer transporting belts 42, 44 in this case are driven independently of one another in order to correct positioning. The central transporting belt 43 is driven at an average speed, and the sheet is therefore deformed as little as possible.

Just as in the first exemplary embodiment according to FIGS. 2 and 3, the sensors 33, 34 sense the leading sheet edge and they control the drive motors 46, 47, 48 in accordance with a desired/actual value comparison.

Of course, provision may also be made in both exemplary embodiments for the transporting belts to be driven through the use of controllable differential gear mechanisms of the feeder or machine drive.

The invention claimed is:

1. An apparatus for feeding and aligning sheets fed to a processing machine, the apparatus comprising:

at least two parallel transporting belts drivable independently of one another at variable speeds;

said transporting belts each having an outer peripheral region directed toward the sheet and an inner region directed toward the sheet and disposed between said outer peripheral regions;

said outer peripheral regions having higher retaining forces than said inner regions; and said transporting belts being configured to be subjected to an action of suction air with a higher level of suction air in said outer peripheral regions than in said inner regions.

2. The apparatus according to claim 1, wherein said transporting belts have an increased level of roughness in said outer peripheral regions.

3. The apparatus according to claim 1, which further comprises individually activatable drive motors each associated with a respective one of said transporting belts.

4. The apparatus according to claim 3, which further comprises sensors sensing positional data of the sheet, said drive motors of said transporting belts being activated in accordance with a desired/actual value comparison of said positional data.

5. An apparatus for feeding and aligning sheets fed to a processing machine, the apparatus comprising:

three parallel transporting belts drivable independently of one another at variable speeds;

said transporting belts including two outer transporting belts and a central transporting belt;

said outer transporting belts having a higher retaining force than said central transporting belt: and said transporting belts being configured to be subjected to an action of suction air with said outer transporting belts subjected to a higher level of negative pressure than said central transporting belt.

6. The apparatus according to claim 5, wherein said outer transporting belts have a higher level of surface roughness than said central transporting belt.

7. The apparatus according to claim 5, which further comprises individually activatable drive motors each associated with a respective one of said transporting belts.

8. The apparatus according to claim 7, wherein said central transporting belt is configured to be driven at a speed being an average of the speeds of said outer transporting belts.

9. The apparatus according to claim 8, which further comprises sensors sensing positional data of the sheet, said drive motors of said transporting belts being activated in accordance with a desired/actual value comparison of said positional data.

10. The apparatus according to claim 7, which further comprises sensors sensing positional data of the sheet, said drive motors of said transporting belts being activated in accordance with a desired/actual value comparison of said positional data.

* * * * *